US011788322B2

(12) United States Patent
Chan

(10) Patent No.: US 11,788,322 B2
(45) Date of Patent: Oct. 17, 2023

(54) ELECTRIC LOCK AND CLUTCH MECHANISM THEREOF

(71) Applicant: Taiwan Fu Hsing Industrial Co., Ltd., Kaohsiung (TW)

(72) Inventor: Tien-Fu Chan, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 164 days.

(21) Appl. No.: 17/141,243

(22) Filed: Jan. 5, 2021

(65) Prior Publication Data

US 2022/0025675 A1 Jan. 27, 2022

(30) Foreign Application Priority Data

Jul. 27, 2020 (TW) ..... 109125321

(51) Int. Cl.
*E05B 47/00* (2006.01)
*E05B 1/00* (2006.01)
*E05B 17/04* (2006.01)

(52) U.S. Cl.
CPC ..... *E05B 47/0001* (2013.01); *E05B 1/0007* (2013.01); *E05B 17/044* (2013.01);
(Continued)

(58) Field of Classification Search
CPC ..... E05B 2047/002; E05B 2047/0017; E05B 2047/0024; E05B 2047/0026; E05B 2047/0031; E05B 2047/0036; E05B 2047/0067; E05B 2047/0069; E05B 2047/0084; E05B 2047/0085; E05B 2047/0091; E05B 9/02; E05B 3/06; E05B 47/0012; E05B 47/02; E05B 47/026; E05B 17/044; E05B 17/045; E05B 2047/0018;
(Continued)

(56) References Cited

U.S. PATENT DOCUMENTS 7,827,837 B2 * 11/2010 Huang ..... E05B 47/068 70/279.1
10,385,588 B2 8/2019 Huang et al.
(Continued)

FOREIGN PATENT DOCUMENTS

CN 108798236 A 11/2018
CN 110159084 A 8/2019

*Primary Examiner* — Christine M Mills
*Assistant Examiner* — Peter H Watson

(57) ABSTRACT

An electric lock includes a housing, a clutch mechanism and a manual control member. The housing is formed with a driving structure having a first inclined surface, a second inclined surface and a bottom surface. The clutch mechanism includes a driving member having a pushing structure, an elastic member arranged on the driving member for abutting against the driving structure, a rotating member having a pushed structure, and a motor for driving the driving member to rotate. The manual control member is connected to the rotating member. When the motor drives the driving member to rotate relative to the driving structure, the elastic member abuts against the first or second inclined surface to push the driving member to move toward the rotating member, so as to allow the pushing structure to abut against the pushed structure, in order to further drive the rotating member to rotate the manual control member.

15 Claims, 6 Drawing Sheets

(52) U.S. Cl.
CPC .... *E05B 47/0012* (2013.01); *E05B 2047/002* (2013.01); *E05B 2047/0017* (2013.01); *E05B 2047/0026* (2013.01); *E05B 2047/0031* (2013.01); *E05B 2047/0036* (2013.01); *E05B 2047/0091* (2013.01); *E05Y 2201/216* (2013.01); *E05Y 2201/474* (2013.01); *E05Y 2201/676* (2013.01); *E05Y 2201/686* (2013.01)

(58) Field of Classification Search
CPC ..... E05B 2047/003; E05B 47/0001; Y10T 292/1021
See application file for complete search history.

(56) References Cited

U.S. PATENT DOCUMENTS

| | | | | |
|---|---|---|---|---|
| 10,563,705 | B2 | 2/2020 | Lu | |
| 2010/0212381 | A1* | 8/2010 | Huang | E05B 47/068 70/279.1 |
| 2012/0036904 | A1* | 2/2012 | Chang | E05B 47/02 70/91 |
| 2018/0320411 | A1* | 11/2018 | Huang | E05B 47/0012 |
| 2019/0249723 | A1* | 8/2019 | Lu | F16D 21/06 |

* cited by examiner

ELECTRIC LOCK AND CLUTCH MECHANISM THEREOF

BACKGROUND OF THE INVENTION

1. Field of the Invention

The present invention relates to an electric lock, and more particularly, to an electric lock having an improved clutch mechanism.

2. Description of the Prior Art

Generally, an electric lock can be operated in an electronic control mode or a manual control mode. In the electronic control mode, locking or unlocking operation is performed according to an input instruction of a user. In the manual control mode, the user uses a manual control member of the electric lock to perform locking or unlocking operation. In order to prevent the electric lock from being damaged due to improper operation, the electric lock usually has a clutch mechanism to prevent mutual interference between the electronic control mode and the manual control mode. However, the clutch mechanism of the electric lock of the prior art has a more complex structure and more components, such that the appearance design of the electric lock is limited and the electric lock has poorer reliability.

SUMMARY OF THE INVENTION

The present invention relates to an electric lock and a clutch mechanism thereof.

The electric lock of the present invention comprises a housing, a clutch mechanism and a manual control member. The housing is formed with a driving structure and a shaft hole. The driving structure has a first inclined surface, a second inclined surface and a bottom surface located between bottom portions of the first inclined surface and the second inclined surface. The clutch mechanism comprises a driving member having a pushing structure, an elastic member arranged on the driving member for abutting against the driving structure, a rotating member having a pushed structure, and a motor configured to drive the driving member to rotate relative to the driving structure. The manual control member is connected to the rotating member through the shaft hole. When the motor drives the driving member to rotate relative to the driving structure, the elastic member is configured to abut against the first or second inclined surface to push the driving member to move toward the rotating member, so as to allow the pushing structure to abut against the pushed structure, in order to further drive the rotating member to rotate the manual control member.

The clutch mechanism of the electric lock of the present invention comprises a driving member, an elastic member, a rotating member and a motor. The driving member has a pushing structure. The elastic member is arranged on the driving member for abutting against a driving structure on a housing of the electric lock. The driving structure has a first inclined surface, a second inclined surface and a bottom surface located between bottom portions of the first inclined surface and the second inclined surface. The rotating member has a pushed structure. The motor is configured to drive the driving member to rotate relative to the driving structure. When the motor drives the driving member to rotate relative to the driving structure along a first rotating direction, the elastic member is configured to abut against the first inclined surface to push the driving member to move toward the rotating member, so as to allow the pushing structure to abut against the pushed structure, in order to further drive the rotating member to rotate along the first rotating direction. When the motor drives the driving member to rotate relative to the driving structure along a second rotating direction, the elastic member is configured to abut against the second inclined surface to push the driving member to move toward the rotating member, so as to allow the pushing structure to abut against the pushed structure, in order to further drive the rotating member to rotate along the second rotating direction. The second rotating direction is opposite to the first rotating direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
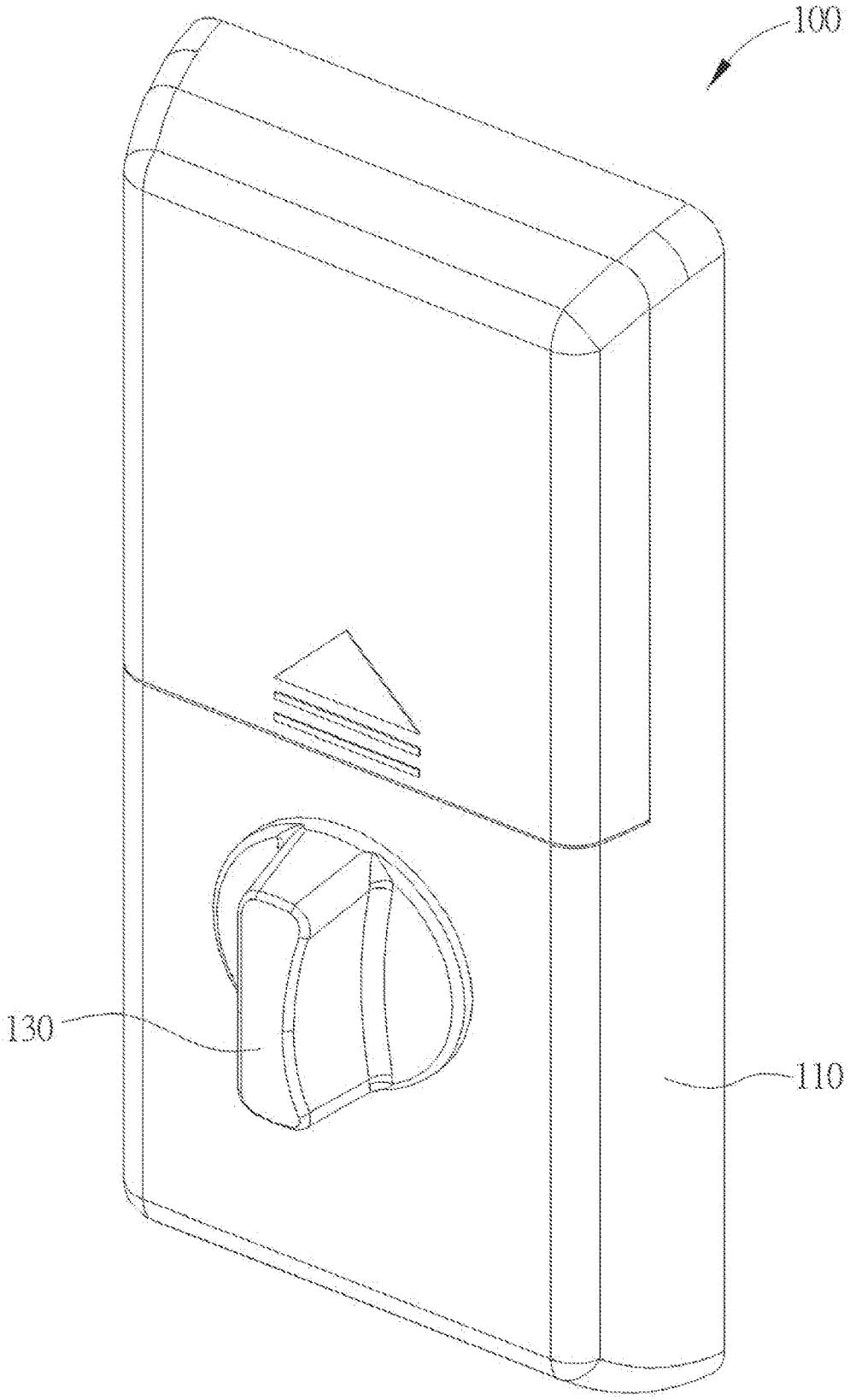
FIG. 1 is a diagram showing an electric lock of the present invention.
Figure 2:
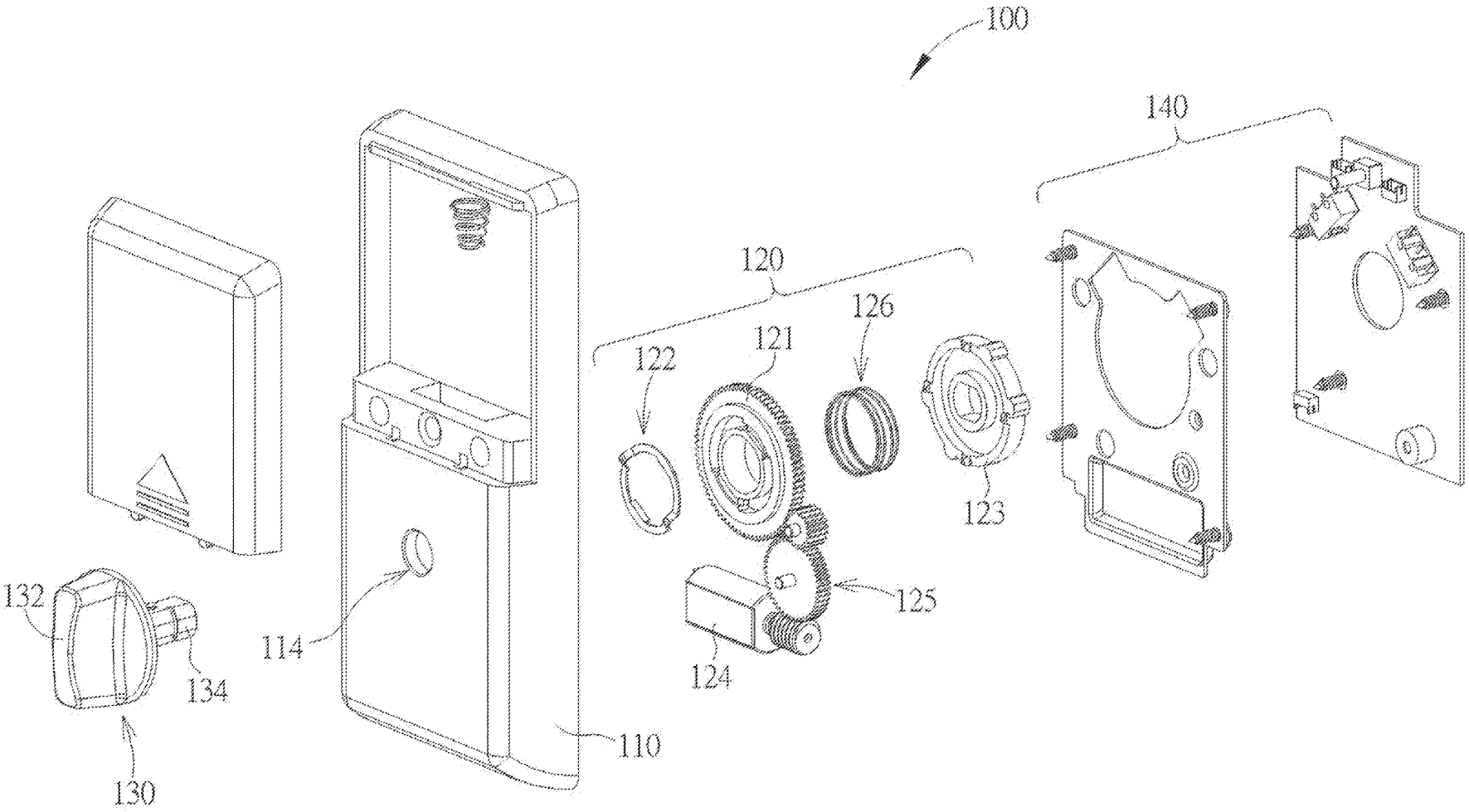
FIG. 2 is an exploded view of the electric lock of the present invention.
Figure 3:
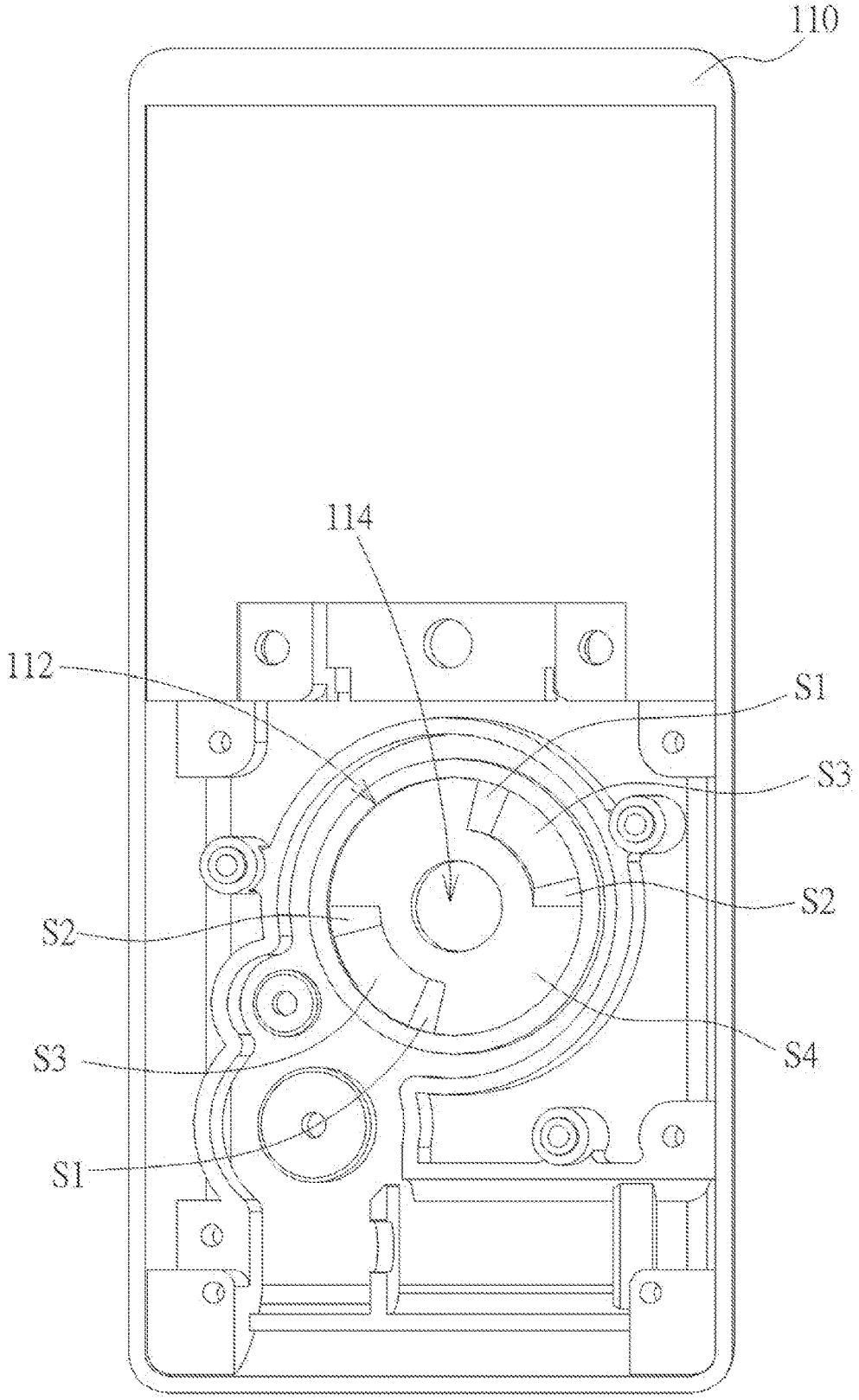
FIG. 3 is a diagram showing a driving structure of the electric lock of the present invention.

Please refer to FIG. 1 to FIG. 3. FIG. 1 is a diagram showing an electric lock of the present invention. FIG. 2 is an exploded view of the electric lock of the present invention. FIG. 3 is a diagram showing a driving structure of the electric lock of the present invention. As shown in figures, an electric lock 100 of the present invention comprises a housing 110, a clutch mechanism 120, a manual control member 130 and a control circuit 140. The housing 110 is formed with a driving structure 112 and a shaft hole 114. The driving structure 112 has a first inclined surface S1, a second inclined surface S2 and a bottom surface S3 located between bottom portions of the first inclined surface S1 and the second inclined surface S2. Moreover, the driving structure 112 further has a top surface S4 connected to top portions of the first inclined surface S1 and the second inclined surface S2. The clutch mechanism 120 comprises a driving member 121, an elastic member 122, a rotating member 123 and a motor 124. The elastic member 122 is arranged on the driving member 121 for abutting against the driving structure 112. The motor 124 is configured to drive the driving member 121 to rotate relative to the driving structure 112. The manual control member 130 is connected to the rotating member 123 through the shaft hole 114. The manual control member 130 comprises a knob 132 and a rotating shaft 134. The knob 132 is arranged at an outer side of the housing 110. The rotating shaft 134 is connected to the knob 132, and passes through the shaft hole 114 and the driving member 121 to be connected to the rotating member 123. The control circuit 140 is configured to control the motor 124 to operate according to a command input by a user.

In the present embodiment, the rotating member 123 is configured to be connected to a latch (not shown in figures) of the electric lock 100 through a transmission rod (not shown in figures). When the rotating member 123 is rotated, the transmission rod is driven by the rotating member 123 to move the latch to an unlocked position or a locked position. In order to perform a manual control mode of the electric lock of the present invention, the manual control member 130 can be used to rotate the rotating member 123. In order to perform an electronic control mode of the electric lock of the present invention, the control circuit 140 can be used to control the motor 124 to rotate to further drive the rotating member 123 to rotate through the driving member 121.

Figure 4:
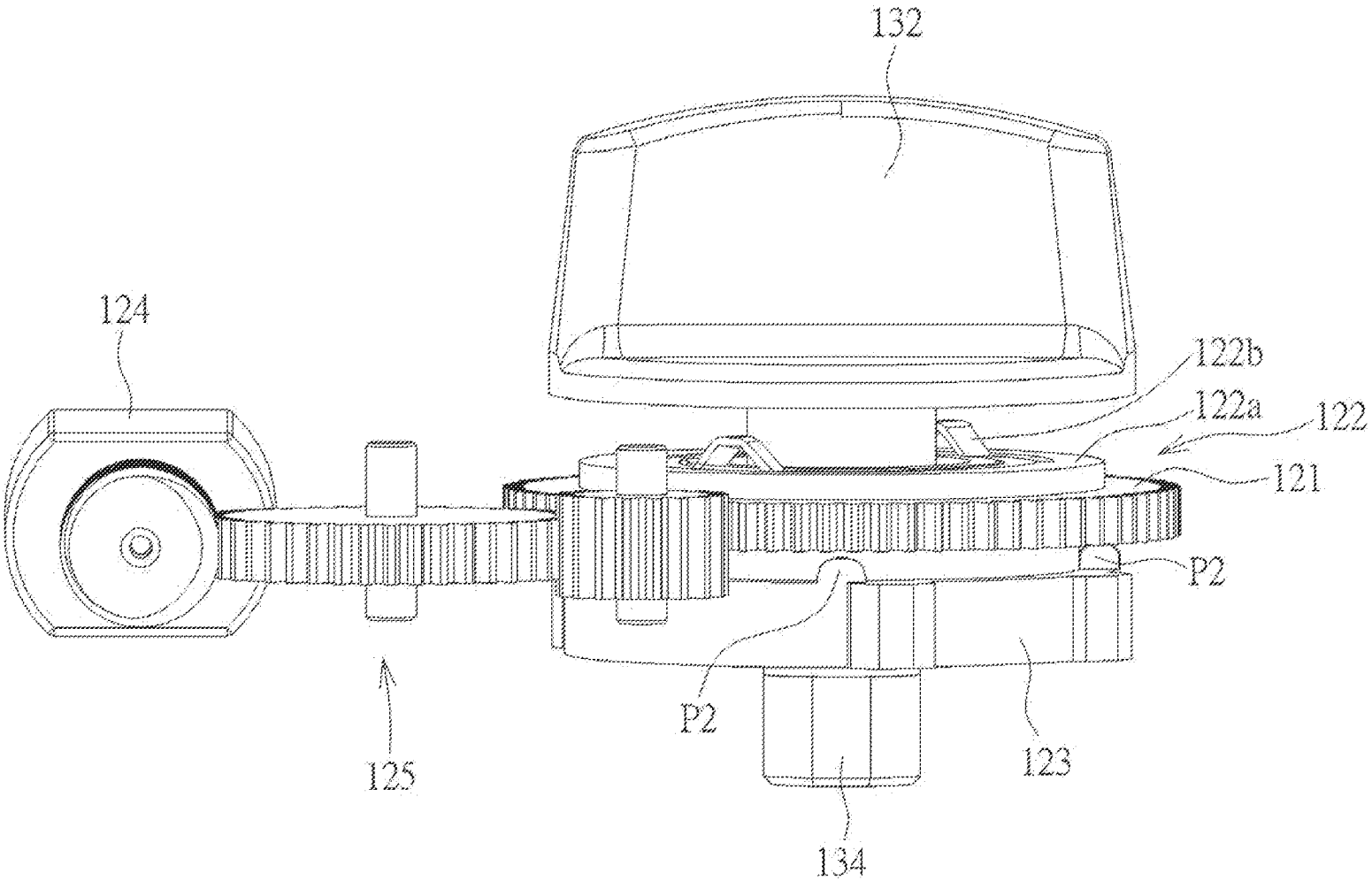
FIG. 4 is a diagram showing a clutch mechanism and a manual control member of the electric lock of the present invention.
Figure 5:
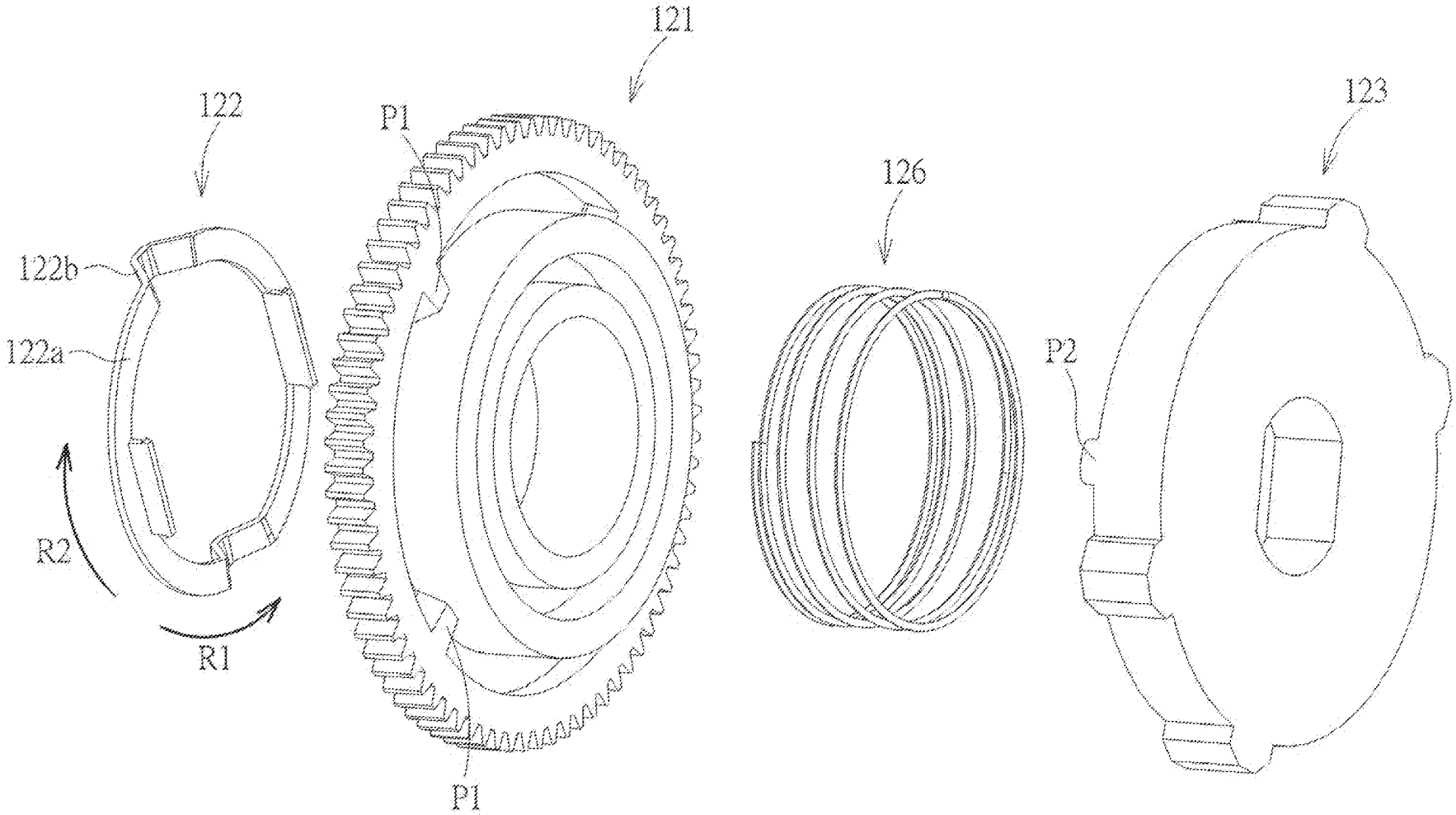
FIG. 5 is a partial exploded view of the clutch mechanism of the electric lock of the present invention.
Figure 6:
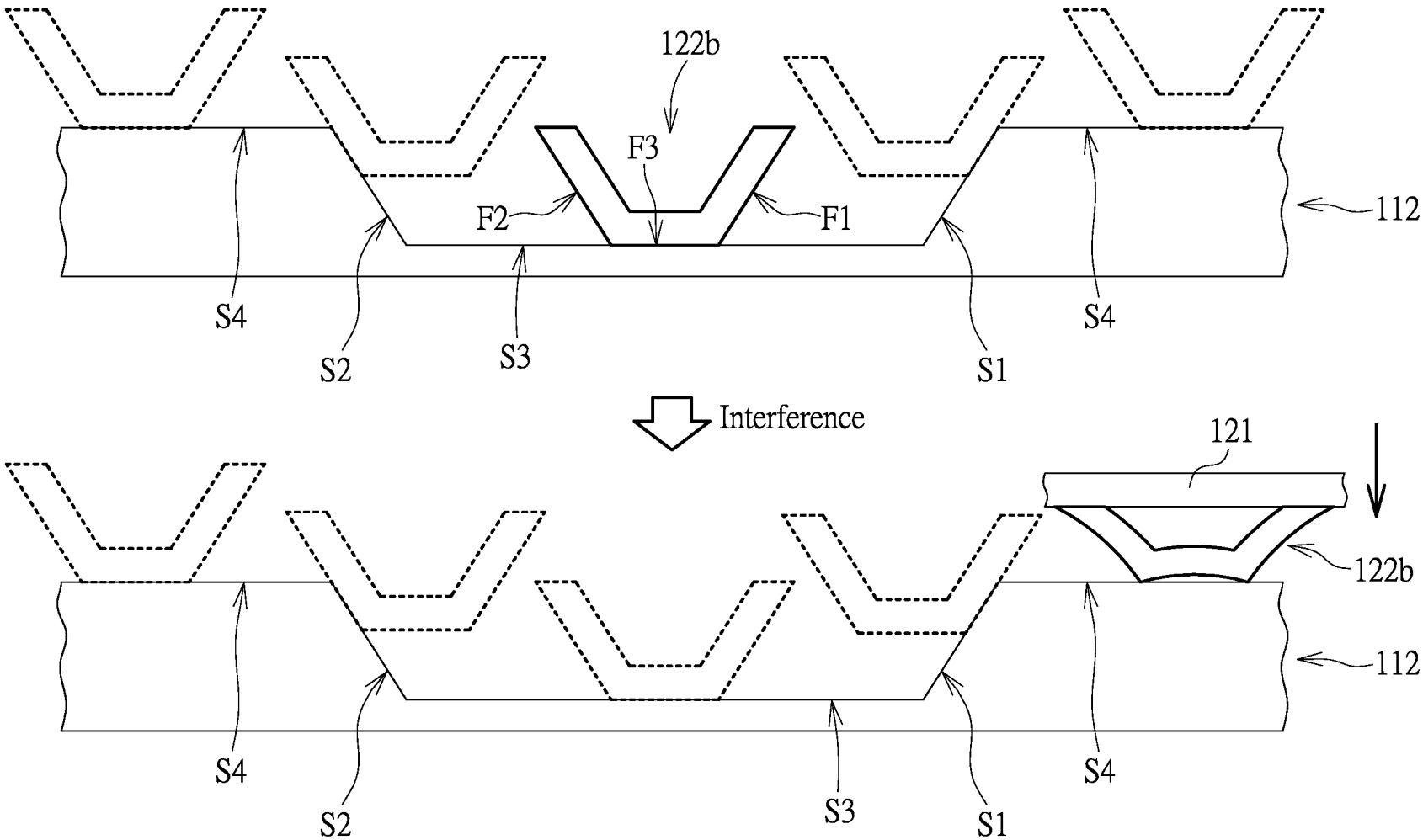
FIG. 6 is a diagram showing relative positions between a protrusion part of an elastic member and a driving structure of the electric lock of the present invention.

Please refer to FIG. 4 to FIG. 6, and refer to FIG. 1 to FIG. 3 as well. FIG. 4 is a diagram showing the clutch mechanism and the manual control member of the electric lock of the present invention. FIG. 5 is a partial exploded view of the clutch mechanism of the electric lock of the present invention. FIG. 6 is a diagram showing relative positions between a protrusion part of the elastic member and the driving structure of the electric lock of the present invention. As shown in figures, the driving member 121 has a pushing structure P1. The elastic member 122 has a main body 122*a* and a protrusion part 122*b*. The main body 122*a* is fixed to the driving member 121. The protrusion part 122*b* is extended from the main body 122*a* toward the driving structure 112 to abut against the driving structure 112. The protrusion part 122*b* has a guiding plane F3 and a plurality of inclined guiding surfaces F1, F2. The rotating member 123 has a pushed structure P2 corresponding to the pushing structure P1. In addition, the clutch mechanism 120 further comprises a gear assembly 125 and a spring 126. The motor 124 is configured to drive the driving member 121 to rotate relative to the driving structure 112 through the gear assembly 125. The spring 126 is arranged between the driving member 121 and the rotating member 123, and configured to push the driving member 121 to move away from the rotating member 123. In a standby state, the guiding plane F3 of the protrusion part 122*b* of the elastic member 122 correspondingly abuts against the bottom surface S3 of the driving structure 112, such that the driving member 121 is away from the rotating member 123. Therefore, when the driving member 121 is rotated, the pushing structure P1 of the driving member 121 is unable to abut against the pushed structure P2 of the rotating member 123.

When the electric lock 100 receives a locking command in the standby state, the control circuit 140 controls the motor 124 to drive the driving member 121 to rotate relative to the driving structure 112 along a first rotating direction R1, and the protrusion part 122*b* of the elastic member 122 is correspondingly moved up along the first inclined surface S1 from the bottom surface S3 of the driving structure 112. The inclined guiding surface F1 of the protrusion part 122*b* of the elastic member 122 further abuts against the first inclined surface S1 to guide the protrusion part 122*b* to move relative to the driving structure 112, in order to further push the driving member 121 to move toward the rotating member 123. When the protrusion part 122*b* of the elastic member 122 is close to the top portion of the first inclined surface S1, the driving member 121 is adjacent to the rotating member 123. As such, when the driving member 121 is further rotated (the guiding plane F3 of the protrusion part 122*b* of the elastic member 122 correspondingly abuts against the top surface S4 of the driving structure 112), the pushing structure P1 of the driving member 121 is configured to abut against the pushed structure P2 of the rotating member 123 to further drive the rotating member 123 to rotate along the first rotating direction R1. When the rotating member 123 is rotated along the first rotating direction R1, the manual control member 130 is correspondingly moved to a first position, and the latch of the electric lock 100 is correspondingly moved to a locked position.

In addition, after the latch of the electric lock 100 is located at the locked position, the control circuit 140 further controls the motor 124 to drive the driving member 121 to rotate relative to the driving structure 112 along a second rotating direction R2 (opposite to the first rotating direction R1), such that the protrusion part 122*b* of the elastic member 122 is moved down along the first inclined surface 31 from the top surface S4 of the driving structure 112, in order to move the driving member 121 gradually away from the rotating member 123 (the spring 126 also pushes the driving member 121 to move away from the rotating member 123) until the guiding plane F3 of the protrusion part 122*b* of the elastic member 122 abuts against the bottom surface S3 of the driving structure 112. In the meantime, the electric lock 100 returns to the standby state.

When the electric lock 100 receives an unlocking command in the standby state, the control circuit 140 controls the motor 124 to drive the driving member 121 to rotate relative to the driving structure 112 along the second rotating direction R2, and the protrusion part 122*b* of the elastic member 122 is correspondingly moved up along the second inclined surface S2 from the bottom surface S3 of the driving structure 112. The inclined guiding surface F2 of the protrusion part 122*b* of the elastic member 122 further abuts against the second inclined surface S2 to guide the protrusion part 122*b* to move relative to the driving structure 112, so as to further push the driving member 121 to move toward the rotating member 123. When the protrusion part 122*b* of the elastic member 122 is close to the top portion of the second inclined surface S2, the driving member 121 is adjacent to the rotating member 123. As such, when the driving member 121 is further rotated (the guiding plane F3 of the protrusion part 122*b* of the elastic member 122 correspondingly abuts against the top surface S4 of the driving structure 112), the pushing structure P1 of the driving member 121 is configured to abut against the pushed structure P2 of the rotating member 123, so as to further drive the rotating member 123 to rotate along the second rotating direction R2. When the rotating member 123 is rotated along the second rotating direction R2, the manual control member 130 is correspondingly moved to a second position, and the latch of the electric lock 100 is correspondingly moved to an unlocked position.

In addition, after the latch of the electric lock 100 is located at the unlocked position, the control circuit 140 further controls the motor 124 to drive the driving member 121 to rotate relative to the driving structure 112 along the first rotating direction R1, such that the protrusion part 122*b* of the elastic member 122 is moved down along the second inclined surface S2 from the top surface S4 of the driving structure 112, in order to move the driving member 121 gradually away from the rotating member 123 (the spring 126 also pushes the driving member 121 to move away from the rotating member 123) until the guiding plane F3 of the protrusion part 122*b* of the elastic member 122 abuts against the bottom surface S3 of the driving structure 112. In the meantime, the electric lock 100 returns to the standby state.

On the other hand, the user can also directly rotate the manual control member 130 when the electric lock 100 is in the standby state, so as to move the latch through the rotating member 123. For example, when the electric lock 100 is in the standby state and the user rotates the manual control member 130 along the first rotating direction R1 to the first position, the rotating member 123 is synchronously rotated along the first rotating direction R1 to move the latch to the locked position; when the electric lock 100 is in the standby state and the user rotates the manual control member 130 along the second rotating direction R2 to the second position, the rotating member 123 is synchronously rotated along the second rotating direction R2 to move the latch to the unlocked position. The driving member 121 is away from the rotating member 123 when the electric lock 100 is in the standby state. Therefore, when the user rotates the manual control member 130, the rotating member 123 does not interact with the driving member 121.

On the other hand, when the electronic control mode and the manual control mode interfere with each other, the clutch mechanism 120 of the present invention can prevent the electric lock 100 from being damaged due to improper operation. For example, when the motor 124 drives the driving member 121 to rotate relative to the driving structure 112 along the first rotating direction R1 and the user rotates the manual control member 130 along the second rotating direction R2, the rotating direction of the driving member 121 is opposite to the rotating direction of the rotating member 123, and the protrusion part 122*b* of the elastic member 122 can be further deformed to allow the driving member 121 to move backward, so as to avoid conflict between the pushing structure P1 of the driving member 121 and the pushed structure P2 of the rotating member 123, which may cause component damage.

According to the aforementioned arrangement, the clutch mechanism 120 of the electric lock of the present invention can smoothly perform the manual control mode and the electronic control mode. When the electronic control mode and the manual control mode interfere with each other, the clutch mechanism 120 of the present invention can also prevent the electric lock 100 from being damaged due to improper operation.

In contrast to the prior art, the clutch mechanism of the electric lock has fewer components to reduce space occupied by the clutch mechanism. Therefore, the electric lock of the present invention can become thinner and have greater appearance design flexibility. Moreover, the clutch mechanism of the electric lock of the present invention has a simpler structure to prevent the electric lock from being damaged due to improper operation, thereby further improving reliability of the electric lock.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electric lock, comprising:

a housing, wherein a driving structure and a shaft hole are formed on the housing, the driving structure has a first inclined surface, a second inclined surface and a bottom surface located between bottom portions of the first inclined surface and the second inclined surface;

a clutch mechanism, comprising:

a driving member having a pushing structure;

an elastic member arranged on the driving member for abutting against the driving structure;

a rotating member having a pushed structure; and a motor configured to drive the driving member to rotate relative to the driving structure; and a manual control member connected to the rotating member through the shaft hole;

wherein when the motor drives the driving member to rotate relative to the driving structure, the elastic member is configured to abut against the first or second inclined surface to push the driving member to move toward the rotating member, so as to allow the pushing structure to abut against the pushed structure, such that the motor further drives the rotating member to rotate the manual control member through the driving member;

wherein when a rotating direction of the driving member is opposite to a rotating direction of the rotating member, the elastic member is configured to be deformed between the driving structure and the driving member to allow the driving member to move away from the rotating member, so as to avoid damage by conflict between the pushing structure of the driving member and the pushed structure of the rotating member.

2. The electric lock of claim 1, wherein when the motor drives the driving member to rotate relative to the driving structure along a first rotating direction, the elastic member is configured to abut against the first inclined surface to push the driving member to move toward the rotating member, so as to allow the pushing structure to abut against the pushed structure, in order to further drive the rotating member to rotate the manual control member to a first position; wherein when the motor drives the driving member to rotate relative to the driving structure along a second rotating direction, the elastic member is configured to abut against the second inclined surface to push the driving member to move toward the rotating member, so as to allow the pushing structure to abut against the pushed structure; in order to further drive the rotating member to rotate the manual control member to a second position; wherein the second rotating direction is opposite to the first rotating direction.

3. The electric lock of claim 1, wherein when the elastic member abuts against the bottom surface, the driving member is away from the rotating member, such that the pushing structure is unable to abut against the pushed structure.

4. The electric lock of claim 1, wherein the clutch mechanism further comprises a gear assembly; and the motor is configured to drive the driving member to rotate relative to the driving structure through the gear assembly.

5. The electric lock of claim 1, wherein the manual control member comprises:

a knob arranged on an outer side of the housing; and a rotating shaft connected to the knob and passing through the shaft hole and the driving member to be connected to the rotating member.

6. The electric lock of claim 1, wherein the rotating member is configured to be connected to a latch through a transmission rod; wherein when the rotating member rotates, the transmission rod is driven to move the latch.

7. The electric lock of claim 1, wherein the clutch mechanism further comprises a spring arranged between the driving member and the rotating member and configured to push the driving member to move away from the rotating member.

8. The electric lock of claim 1, wherein the elastic member comprises:

a main body fixed to the driving member; and a protrusion part extended from the main body toward the driving structure.

9. The electric lock of claim 8, wherein the driving structure further has a top surface connected to top portions of the first inclined surface and the second inclined surface, the protrusion part has a guiding plane and a plurality of inclined guiding surfaces, the guiding plane is configured to correspondingly abut against the bottom surface or the top surface, and the plurality of inclined guiding surfaces are configured to respectively abut against the first inclined surface and the second inclined surface to guide the protrusion part to move relative to the driving structure.

10. A clutch mechanism of an electric lock, comprising:

a driving member having a pushing structure;

an elastic member arranged on the driving member for abutting against a driving structure formed on a housing of the electric lock, wherein the driving structure has a first inclined surface, a second inclined surface and a bottom surface located between bottom portions of the first inclined surface and the second inclined surface;

a rotating member having a pushed structure; and a motor configured to drive the driving member to rotate relative to the driving structure;

wherein when the motor drives the driving member to rotate relative to the driving structure along a first rotating direction, the elastic member is configured to abut against the first inclined surface to push the driving member to move toward the rotating, member, so as to allow the pushing structure to abut against the pushed structure, such that the motor further drives the rotating member to rotate along the first rotating direction through the driving member;

wherein when the motor drives the driving member to rotate relative to the driving structure along a second rotating direction, the elastic member is configured to abut against the second inclined surface to push the driving member to move toward the rotating member, so as to allow the pushing structure to abut against the pushed structure, such that the motor further drives the rotating member to rotate along the second rotating direction through the driving member;

wherein the second rotating direction is opposite to the first rotating direction;

wherein when a rotating direction of the driving member is opposite to a rotating direction of the rotating member, the elastic member is configured to be deformed between the driving structure and the driving member to allow the driving member to move away from the rotating member, so as to avoid damage by conflict between the pushing structure of the driving member and the pushed structure of the rotating member.

11. The clutch mechanism of claim 10, wherein when the elastic member abuts against the bottom surface, the driving member is away from the rotating member, such that the pushing structure is unable to abut against the pushed structure.

12. The clutch mechanism of claim 10, further comprising a gear assembly; wherein the motor is configured to drive the driving member to rotate relative to the driving structure through the gear assembly.

13. The clutch mechanism of claim 10, further comprising a spring arranged between the driving member and the rotating member, and configured to push the driving member to move away from the rotating member.

14. The clutch mechanism of claim 10, wherein the elastic member comprises:

a main body fixed to the driving member; and a protrusion part extended from the main body toward the driving structure.

15. The clutch mechanism of claim 14, wherein the driving structure further has a top surface connected to top portions of the first inclined surface and the second inclined surface, the protrusion part has a guiding plane and a plurality of inclined guiding surfaces, the guiding plane is configured to correspondingly abut against the bottom surface or the top surface, and the plurality of inclined guiding surfaces are configured to respectively abut against the first inclined surface and the second inclined surface to guide the protrusion part to move relative to the driving structure.

* * * * *